US008469437B2

(12) United States Patent
Zanetti et al.

(10) Patent No.: US 8,469,437 B2
(45) Date of Patent: Jun. 25, 2013

(54) MOVEMENT DEVICE AND ASSEMBLY

(75) Inventors: Davide Zanetti, Brescia (IT); Matteo Maifrini, Brescia (IT)

(73) Assignee: Ship-Car S.r.l. Societá a Socio Unico, Gavardo, Brescia (IT)

( * ) Notice: Subject to any disclaimer, the term of this patent is extended or adjusted under 35 U.S.C. 154(b) by 60 days.

(21) Appl. No.: 13/119,873

(22) PCT Filed: Sep. 19, 2008

(86) PCT No.: PCT/IT2008/000604

§ 371 (c)(1),
(2), (4) Date: Mar. 31, 2011

(87) PCT Pub. No.: WO2010/032273

PCT Pub. Date: Mar. 25, 2010

(65) Prior Publication Data

US 2011/0173893 A1 Jul. 21, 2011

(51) Int. Cl.
*E05D 15/10* (2006.01)
*E05D 11/02* (2006.01)

(52) U.S. Cl.
USPC ..... 296/146.16; 49/363; 49/404

(58) Field of Classification Search
USPC ..... 296/146.16, 146.1, 146.11, 146.12, 296/155, 241; 49/502, 216, 362, 209, 213, 49/363, 404
See application file for complete search history.

(56) References Cited

U.S. PATENT DOCUMENTS

| | | | | | |
|---|---|---|---|---|---|
| 1,712,562 | A * | 5/1929 | Jeffers | 49/214 |
| 3,204,999 | A * | 9/1965 | Schwenk | 49/213 |
| 3,216,716 | A * | 11/1965 | Lunde et al. | 49/103 |
| 4,152,872 | A * | 5/1979 | Tanizaki et al. | 49/214 |
| 5,467,557 | A * | 11/1995 | Jones | 49/171 |
| 5,613,323 | A * | 3/1997 | Buening | 49/380 |
| 5,992,097 | A * | 11/1999 | Makiuchi et al. | 49/216 |
| 6,328,374 | B1 * | 12/2001 | Patel | 296/155 |
| 7,395,631 | B2 * | 7/2008 | Lahnala | 49/213 |
| 2005/0210751 | A1 * | 9/2005 | Kraus et al. | 49/349 |
| 2007/0234644 | A1 | 10/2007 | Jaeger et al. | |
| 2009/0107052 | A1 * | 4/2009 | Dufour et al. | 49/413 |
| 2010/0071270 | A1 * | 3/2010 | Seiple et al. | 49/413 |

FOREIGN PATENT DOCUMENTS

| | | |
|---|---|---|
| CH | 626941 | 12/1981 |
| FR | 2833209 | 6/2003 |

* cited by examiner

*Primary Examiner* — Glenn Dayoan
*Assistant Examiner* — Sunsurraye Westbrook
(74) *Attorney, Agent, or Firm* — Shoemaker and Mattare

(57) ABSTRACT

A movement device has a longitudinal translation guide which can be joined to a fixed frame and is suitable for allowing translation of a mobile element along a primary translation axis between a configuration of at least partial superimposition of the mobile element with the frame opening, and at least one configuration of non-alignment with the opening. When the mobile element is in the configuration of superimposition, it can be moved along a secondary movement axis, incident to the primary translation axis, between the configuration of superimposition and a closing configuration where the mobile element is engaged in the frame opening. The secondary trajectory is substantially linear or rectilinear at least in its terminal section towards the frame opening.

16 Claims, 6 Drawing Sheets

Fig. 9a
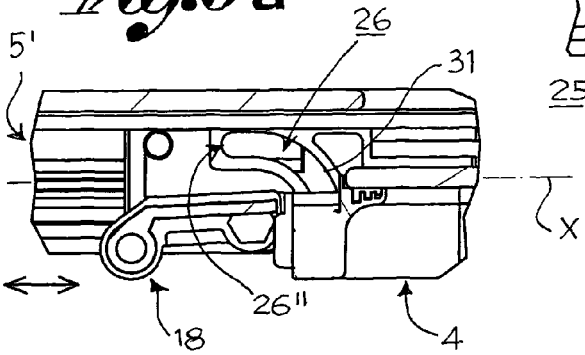
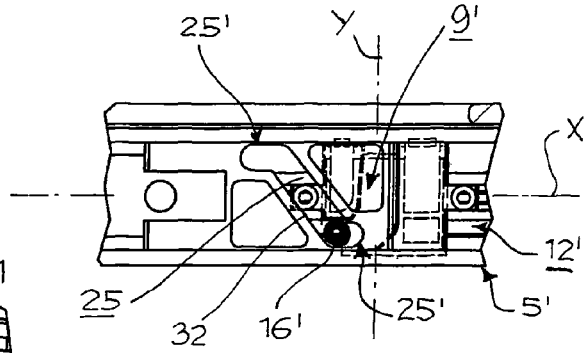
Fig. 9b
Fig. 10a
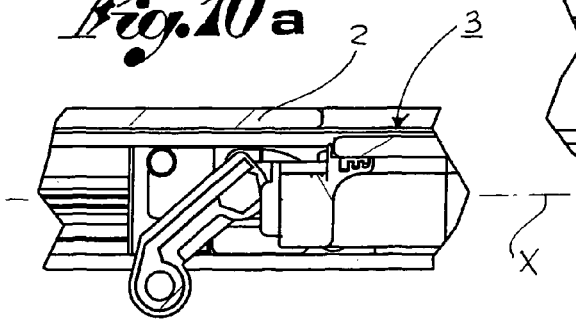
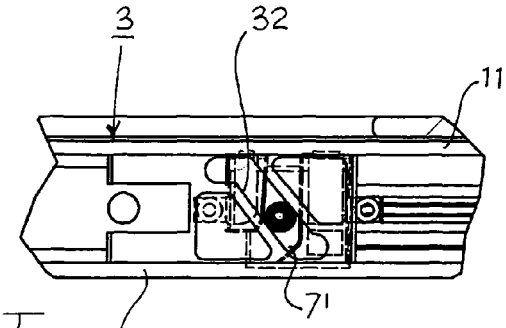
Fig. 10b
Fig. 11a
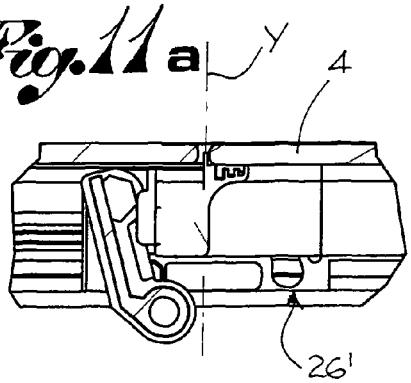
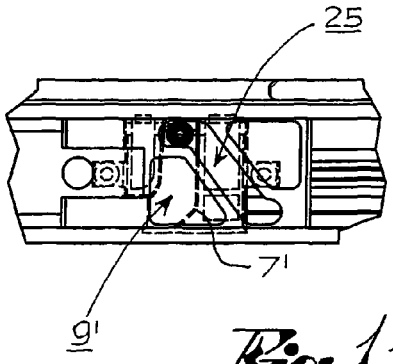
Fig. 11b

MOVEMENT DEVICE AND ASSEMBLY

BACKGROUND OF THE INVENTION

1. Field of the Invention

The present invention relates to a movement device of a mobile element, such as a door, a window or similar, in relation to a fixed frame, and a movement assembly.

2. Description of the Prior Art

Devices for moving a mobile element such as a door, a window, a sunroof, a panel door or similar in relation to a fixed frame are known of in the art. The fixed frame usually extends along a frame plane, e.g. a vertical plane, and defines within it a frame opening suitable for being engaged by the moving element.

The known devices usually comprise a longitudinal translation guide, to enable translation of the mobile element in relation to the fixed frame. Such translation guide has a curvilinear-shaped extremity portion facing the frame opening, so that the opening is initially engaged by a first rim of the mobile element, and that subsequently a second rim, parallel and opposite the first, is pressed by the user so that the second rim too engages the frame opening, in a rotatory movement.

However, the devices described above have some limitations or drawbacks.

In particular, the known devices are constrained to use mobile elements of reduced thickness, typically between 2 and 6 millimetres, because greater thicknesses would lead to excessive encumbrance of the mobile element during translation in the curvilinear section, such as to prevent its complete entry inside the frame opening.

Furthermore, two separate maneuvers are usually required, first of translation and then of rotation of the mobile element, the second being constrained to the exact positioning of the mobile element at the end of the translation step. It frequently happens that, for example due to the presence of dirt, dust or rust in the translation guides, or due to the wear of the same, after some time the movement of the mobile element jams or in any case requires a considerable manual effort.

The aim of the present invention is therefore to overcome the drawbacks of the known technique and specifically, the ones mentioned above.

SUMMARY OF THE INVENTION

Such purpose is achieved by a movement device of a mobile element, such as a door, a window or similar, in relation to a fixed frame, wherein the fixed frame develops in a frame plane and defines within it a frame opening engageable by the mobile element. The device comprises at least one longitudinal translation guide, joinable to the fixed frame and suitable for allowing the translation of the mobile element along a primary translation axis, substantially parallel to the frame plane, between a configuration of at least partial superimposition of the mobile element with the frame opening, and at least one configuration of non-alignment with the opening, and transversal moving means, operatively connected to the mobile element so as to enable, when the latter is in the configuration of at least partial superimposition, its movement along a secondary trajectory, incident to the primary translation axis, between the configuration of at least partial superimposition and an advanced or closing configuration, wherein the mobile element is at least partially engaged in the frame opening; this secondary trajectory is substantially linear or rectilinear at least in its terminal section towards the frame opening. The above purpose is achieved also by means of a movement assembly comprising the abovementioned movement device. The dependent claims show preferred embodiments.

BRIEF DESCRIPTION OF THE DRAWINGS

The object of the present invention will now be described in detail, with the help of the attached tables, wherein:

FIGS. 9*a*, 10*a* and 11*a* show three views from above, of the extremity illustrated in FIG. 7, during three functioning steps of the device;

FIGS. 9*b*, 10*b* and 11*b* show three views from above, of the extremity illustrated in FIG. 8, during the three corresponding functioning steps illustrated in FIGS. 9*a*, 10*a* and 11*a* where, for a clearer representation, the mobile element has been omitted.

DESCRIPTION OF THE PREFERRED EMBODIMENT

Figure 1:
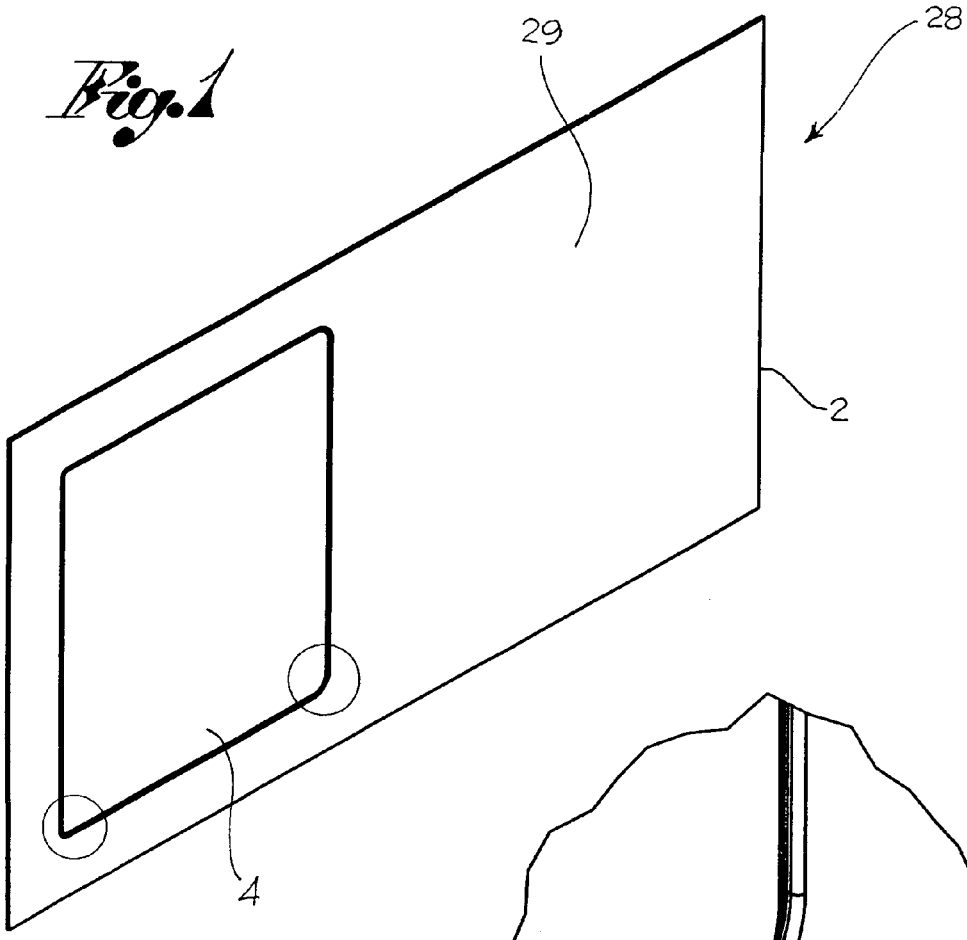
FIGS. 1 and 2 show two perspective views of the movement assembly of the present invention, seen from the outside, according to a possible embodiment, illustrating respectively, an advanced or closing configuration and a configuration of at least partial superimposition of the mobile element over the frame opening.
Figure 3B:
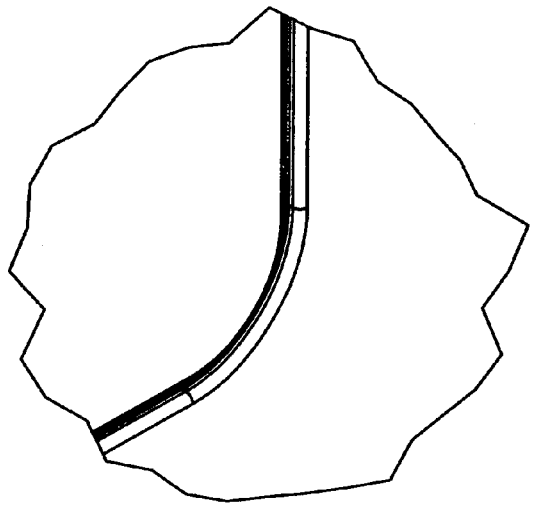
FIGS. 3*a*, 3*b* and 4*a*, 4*b* show two enlargements of the areas marked by the circles in FIGS. 1 and 2, respectively.
Figure 3A:
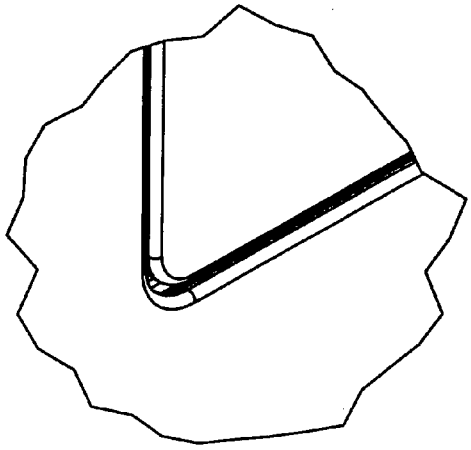

With reference to the aforesaid tables, reference numeral 1 globally indicates, in its totality, a movement device of a mobile element 4, such as for example a door, a window or similar, in relation to a fixed frame 2, for example of a vehicle.

The device 1 is in fact suitable, as a non-limiting example, for the use in both cars, buses, minivans and boats, for the movement of windows, hatchways, trap doors or of sun roofs.

The fixed frame 2, for example joinable to a vehicle, extends along a plane frame Z and defines within it a frame opening 3, engageable by the mobile element 4.

According to a preferred embodiment, the fixed frame 2 comprises a lateral portion 29, which extends along the frame plane Z and is positioned laterally to the frame opening 3.

Preferably, the lateral portion 29 is at least partially transparent to light.

In other words, according to this embodiment, the lateral portion 29 comprises a glass pane or similar, if necessary partially obscured, for example to dim the intensity of the sunlight.

The movement device 1 comprises at least one longitudinal translation guide 5', 5", joinable to the fixed frame 2 and suitable for enabling the translation of the mobile element 4 along a primary translation axis, substantially parallel to the frame plane Z.

Figure 2:
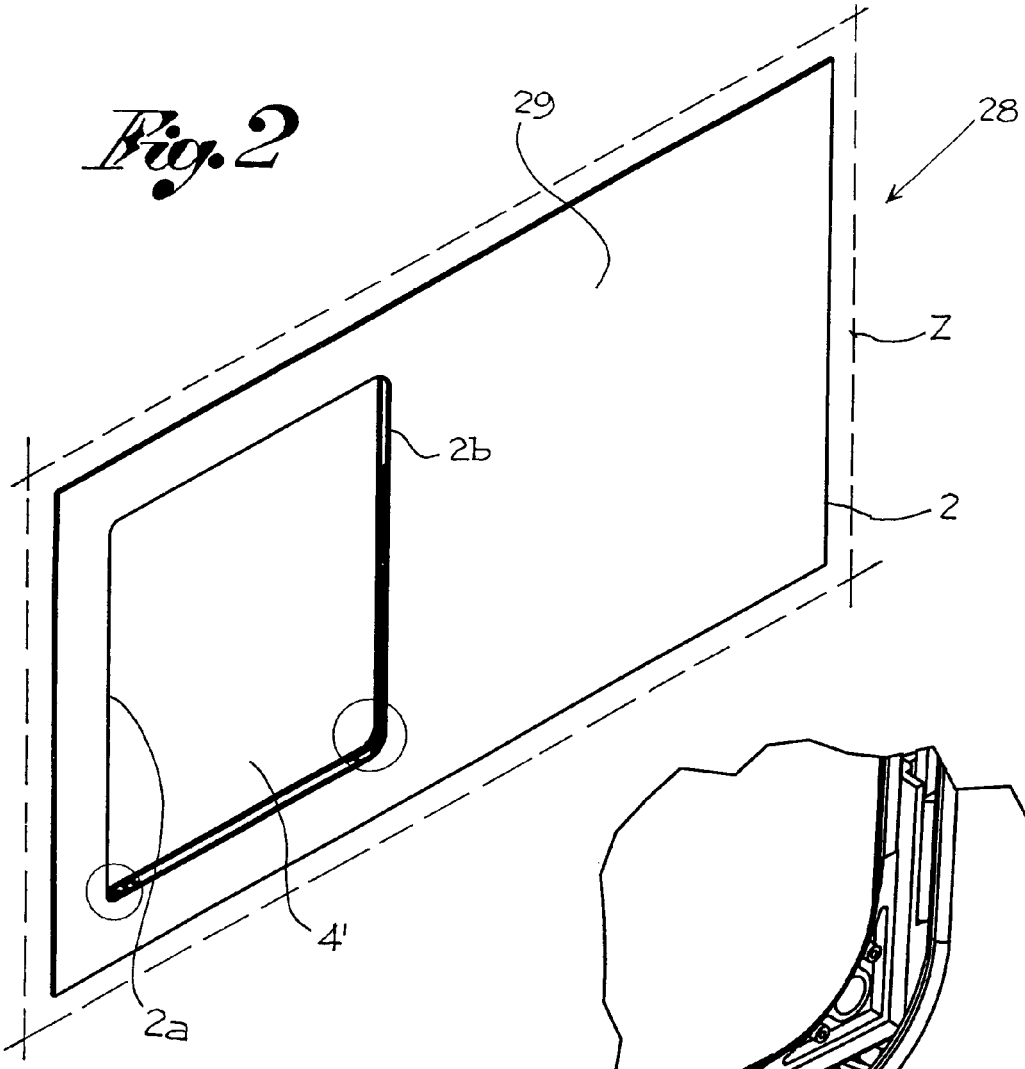
Figure 4B:
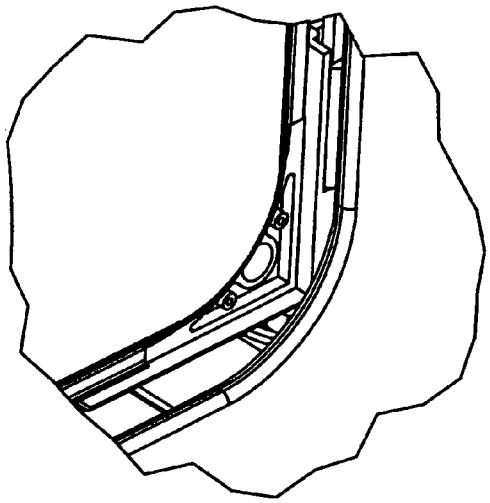
Figure 4A:
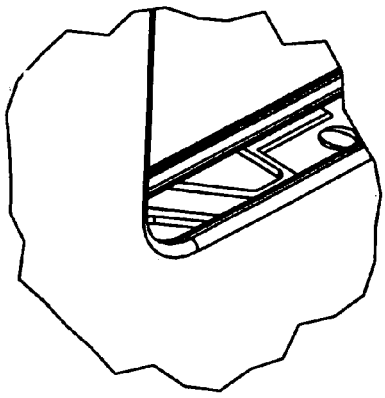

This translation takes place from a configuration of at least partial superimposition of the mobile element 4 with the frame opening 3, for example illustrated in FIG. 2, and at least one configuration of non-alignment with the frame opening 3, not shown.

In other words, in the configuration of non-alignment, the mobile element 4 cannot be seen inside the frame opening 3 by an observer, except for a small segment adjacent to the first extremity rim 4*a*, in that it is mainly aside in relation to the frame opening 3.

According to an embodiment, the longitudinal translation guide 5', 5" comprises a first 10 and a second shoulder 11, which identify at least one translation track 12', 12", for the sliding of the mobile element 4.

According to a further embodiment, the longitudinal translation guide 5', 5" also comprises at least one longitudinal cordon 13, substantially parallel and comprised between the first 10 and second shoulder 11.

In other words, the longitudinal cordon 13 separates the translation guide 5' into two translation tracks 12', 12".

According to a further embodiment variation, the first translation track 12' is suitable for co-operating with the mobile element 4 to perform the aforesaid longitudinal translation.

According to a further embodiment variation, the second translation track 12", when mounted on the fixed frame 2, is suitable for collecting the condensate forming on the fixed frame 2 or on the mobile element 4, and, if necessary, to channel it where desired.

The movement device 1 further comprises transversal moving means, operatively connected to the mobile element 4 so as to allow, when the latter is in the configuration of at least partial superimposition, its movement along a secondary trajectory Y, incident to the primary translation axis X.

This movement takes place between the configuration of at least partial superimposition and an advanced or closing configuration, in which the mobile element 4 is at least partially engaged in the frame opening 3.

Preferably, in the advanced or closing configuration, the mobile element 4 is engaged in the frame opening 3 in such a way that the outer surface 4' of the mobile element, that is to say the one facing the frame opening 3, is substantially on a level with the lateral portion 29.

In other words, in such configuration, the outer surface 4' of the mobile element 4 is substantially at the same height as the outer surface of the lateral portion 29, for the embodiments foreseeing the latter.

In still other words, in the advanced or closing configuration, the mobile element 4 and the frame constitute a surface which extends continuously, substantially without raised or undercut portions.

Furthermore, the secondary trajectory Y is substantially linear or rectilinear in its final section towards the frame opening 3.

In other words, the transversal moving means are suitable for moving the first 4*a* and the second rim 4*b* linearly along the secondary trajectory Y.

In still other words, the transversal moving means are suitable for moving the first 4*a* and the second rim 4*b* at least partially simultaneously along the secondary trajectory Y.

In yet other words, the engagement of the mobile element 4 in the frame opening 3 occurs with a purely linear and non-rotatory movement.

In the embodiment shown in the figures, the secondary trajectory Y is substantially orthogonal to the primary translation axis X.

According to a preferred embodiment, the transversal moving means are suitable for moving the mobile element 4 keeping it substantially parallel to the frame plane Z.

In other words, the mobile element 4 extends in a mobile element plane V, parallel to the frame plane Z. The transversal moving means are therefore suitable for moving the mobile element 4 keeping such planes V, Z substantially parallel.

According to a further preferred embodiment, the mobile element 4 comprises at least a first 4*a* and a second rim 4*b*, reciprocally distanced along the primary translation axis X. The transversal moving means are therefore suitable for simultaneously engaging the rims 4*a*, 4*b* in the frame opening, bringing them against corresponding vertical uprights 2*a*, 2*b* of the frame 2.

Preferably, the transversal moving means comprise at least one maneuvering lever 18, 19, for example operated manually, operatively connected to the mobile element 4 and rotatable around a rotation axis W, substantially orthogonal to the primary translation axis X, in order to make the mobile element 4 translate along the secondary trajectory Y.

In other words, the maneuvering lever 18, 19 is suitable for being rotated between a first position, corresponding to the configuration in which the mobile element 4 is free to translate longitudinally between the configuration of at least partial superimposition and the configuration of non-alignment, and a second position, corresponding to the configuration in which the mobile element 4 is conducted from the configuration of at least partial superimposition to the advanced or closing configuration, and vice versa.

Preferably, the maneuvering lever 18, 19 actuable manually.

According to one embodiment variation, the maneuvering lever 18, 19 is operable by motorised means.

According to the embodiment illustrated in the figures, the first position of the lever 18, 19 is obtained by rotating the maneuvering lever 18, 19 clockwise, while the second position is obtained by rotating the maneuvering lever 18, 19 anti-clockwise.

Preferably, the rotation axis W is translatable along the primary translation axis X.

In other words, during moving of the mobile element 4 between the configuration of at least partial superimposition and the configuration of non-alignment, the rotation axis W moves jointly with the mobile element 4.

Even more preferably, the maneuvering lever 18, 19 comprises at least one lever extremity 19, facing the longitudinal translation guides 5', 5", comprising a first 20 and a second rotation pin 21 substantially parallel to each other, the function of which will be explained soon.

According to a preferred embodiment, the transversal moving means comprise at least one deviator element 6', 6", joined to the longitudinal translation guide 5', 5" and wherein a transversal groove 9', 9" is obtained. The transversal groove 9', 9" extends along the secondary trajectory Y and is suitable for being engaged by a translation pin 16', 16", joined to the mobile element 4. Moreover, the transversal groove 9', 9" is suitable for piloting the translation pin 16', 16" along the secondary trajectory Y, when the maneuvering lever 18, 19 is operated in the second position.

In one embodiment variation, the movement device 1 further comprises at least one fastening element 15', 15" of the mobile element 4 to the longitudinal translation guides 5', 5", bearing the translation pin 16', 16".

In a preferred version, the movement device 1 comprises a first 15' and a second fastening element 15" spaced along the primary translation axis X, for example positioned substantially besides the first 4*a* and second rim 4*b*.

Preferably, the fastening element 15", that is the second fastening element 15", has a connecting surface with the mobile element 4, and a surface opposite the connection surface comprising a bush 17, having an extension mainly orthogonal to the primary translation axis X.

According to a preferred version, the first rotation pin 20 is engaged so as to turn in the bush 17 of the fastening element 15".

According to an advantageous version, the transversal moving means comprises at least a pair of deviator elements 6', 6", spaced along the primary translation axis X, preferably with pitch corresponding to the distance between a pair of translation pins 16', 16", that is the pitch between the first 15' and second fastening element 15".

According to a preferred version, the deviator element 6', 6" comprises a first 7', 7" and a second wall 8', 8", spaced from each other along the primary translation axis X and defining between them the transversal groove 9', 9", spoken of previously.

According to one embodiment, the first wall 7', 7" of the deviator element 6', 6" extends between the first 10 and the second shoulder 11.

According to a further embodiment, the second wall 8', 8" of the deviator element 6', 6" extends between the longitudinal cordon 13 and the second shoulder 11.

Figure 7:
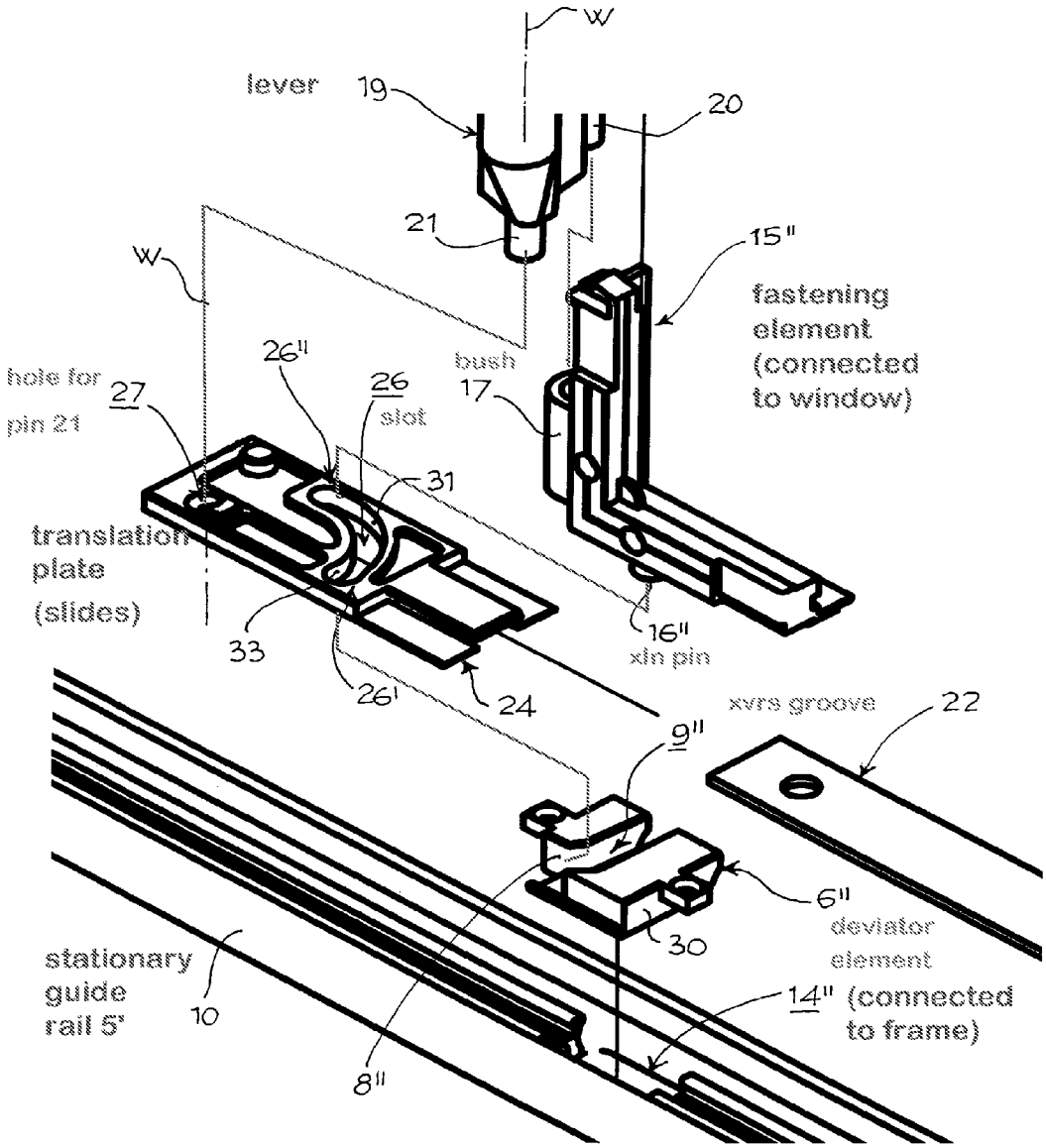
FIGS. 7 and 8 show two further enlargements of the extremity portions of the movement device shown in FIG. 6.
Figure 8:
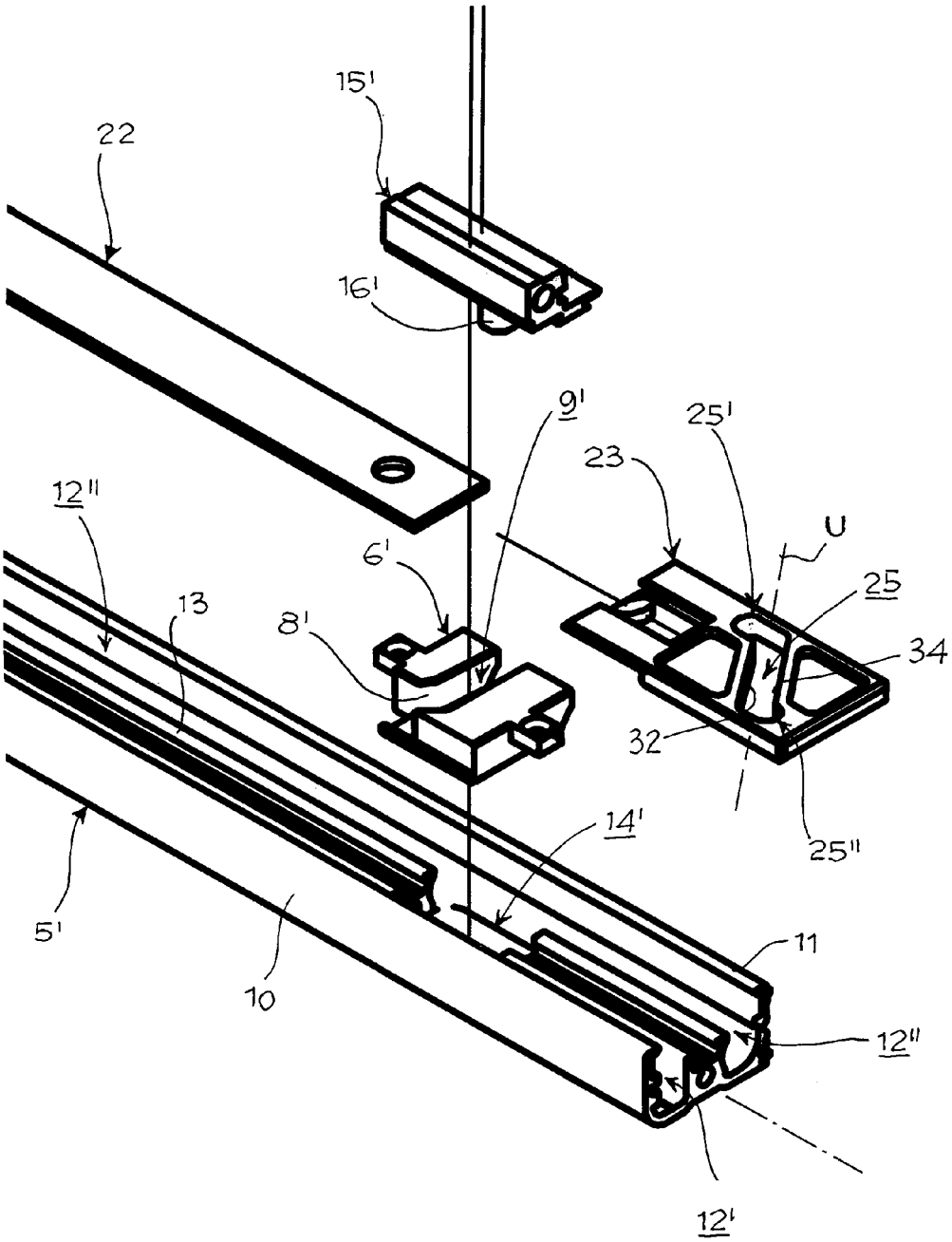

In the variations illustrated in FIGS. 7 and 8, the first wall 7', 7" has an extremity portion of the surface facing the transversal groove 9', 9" that is substantially concave, and the second wall 8', 8" has an extremity portion of the surface facing the transversal groove 9', 9" substantially convex.

Preferably, the longitudinal cordon 13 presents at least a discontinuity or recess 14', 14" suitable for being engaged by the deviator element 6', 6".

This way, the deviator element 6', 6", being positioned inside the recess 14', 14", is prevented from accidentally translating longitudinally.

Even more preferably, the transversal moving means comprise a translation plate 22, 23, 24 comprising at least one through slot 25, 26, suitable for translating in relation to the deviator element 6', 6" along the primary translation axis X. The through slot 25, 26 is suitable for being engaged by the translation pin 16', 16" so that to the translation of the translation plate 22, 23, 24 corresponds the movement of the translation pin 16', 16" along the transversal groove 9', 9".

In other words, as illustrated in the figures, each translation pin 16', 16" first engages the through slot 25, 26, emerging from the underside of it, to then engage the deviator element 6', 6".

As will be explained shortly, these two means co-operate in the movement of the translation pin 16', 16", and therefore of the mobile element 4.

According to a preferred version, the translation plate 22, 23, 24 comprises a first 25 and a second through slot 26, distanced along the primary translation axis X.

Figure 6:
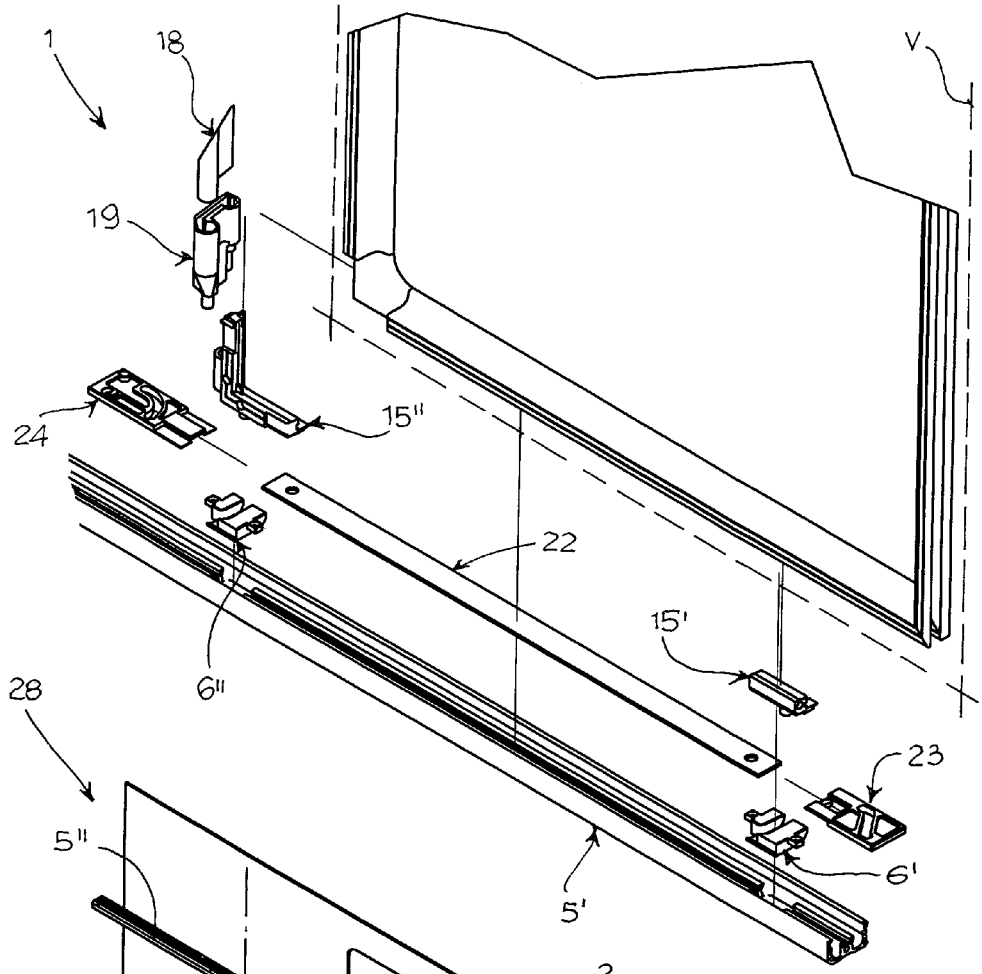
FIG. 6 shows an enlargement of the area marked by the circle in FIG. 5.
Figure 5:
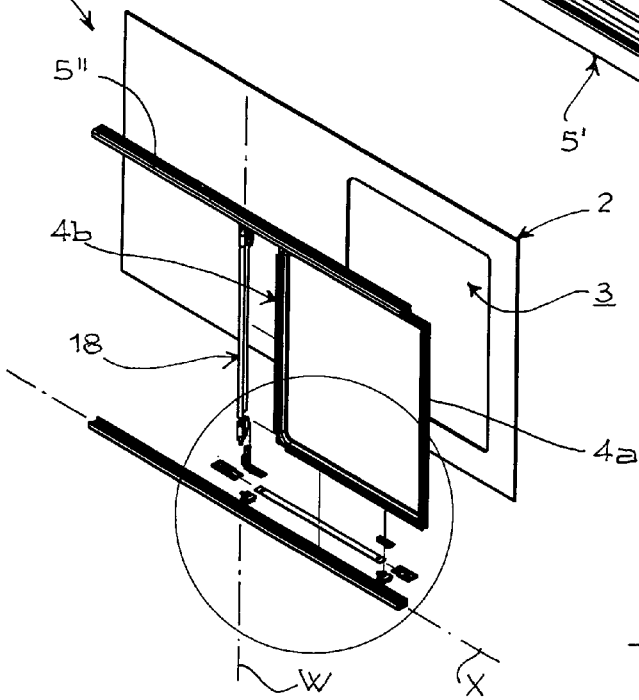
FIG. 5 shows a perspective view from the inside, partially with separated parts, of the movement device of the present invention, according to a possible embodiment.

According to the variation of FIG. 6, the first 25 and the second through slot 26 are mechanically connected by a connection element 22.

Preferably, the translation plate 22, 23, 24 is modular.

In other words, the connection element 22 can be joined to different plate extremities 23, 24, having through slots 25, 26 of different shapes.

In other words again, the connection element 22 may have a variable axle base so as to be suitable for being adapted to various requirements.

According to a preferred embodiment, the first through slot 25 extends mainly along an substantially rectilinear direction U, inclined in relation to the primary translation axis X and in relation to the secondary trajectory Y.

According to a further embodiment, the first through slot 25 has at least one terminal section 25', 25", extending substantially parallel to the primary translation axis X.

Preferably, the first through slot 25 comprises a first 25' and second 25" terminal section, corresponding to the stop positions of the translation pin 16' inside the slot 25.

In other words when, for example, the translation pin 16' occupies the first terminal section 25', it is no longer aligned to the axis of the prevalent extension U of the through slot 25, so that the mobile element 4 cannot be pushed from the outside towards the configuration of at least partial superimposition.

In other words, this feature constitutes a simple and reliable anti-intrusion system for prowlers.

Similarly, the second terminal section 25" prevents the mobile element 4 from approaching the fixed frame 2 at an undesirable moment, causing for example crushing of a child's limbs between them.

According to one version, the extension of the first terminal section 25' is greater than that of the second 25".

Preferably, the second through slot 26 extends along a curvilinear trajectory between a first 26' and a second vertex 26".

In other words, the axis along which the second through slot 26 extends is a curvilinear axis.

Preferably, the conjunction line between the first 26' and the second vertex 26" of the second through slot 26 corresponds substantially to the distance between the first 25' and the second terminal section 25" of the first through slot 25, to obtain the at least partially simultaneous movement of the rims 4*a*, 4*b* in the frame opening 3.

Even more preferably, the contact surfaces of the through slot 25, 26 with the translation pin 16', 16" constitute cam surfaces 31, 32, 33, 34, which extend in an inclined manner in relation to the primary translation axis X and to the secondary trajectory Y, in order to push the translation pin 16', 16" along the transversal groove 9', 9", as will be shown in the functioning example below.

In one embodiment variation, the translation plate 22, 23, 24 further comprises an engagement hole 27 suitable for being engaged in a rotating manner by the second rotation pin 21 of the maneuvering lever 18, 19.

Preferably, the extension axis of the engagement hole 27 is parallel and coincident with the rotation axis W.

According to one embodiment, the device 1 comprises stopping means, suitable for limiting the translation of the mobile element 4 along the primary translation axis X.

In other words, the stopping means enable the translation of the mobile element 4 to be stopped in intermediate positions, between the configuration of at least partial superimposition and the configuration of non-alignment.

For example, the stopping means comprise the second rotation pin 21 of the maneuvering lever 18, 19. Such pin 21 is axially mobile along the rotation axis W, so as to reversibly engage at least a stop hole (not shown) positioned on the longitudinal translation guide 5', 5", preferably on the underside.

In an initial functioning step, the rotation pin 21 is engaged in a first stop hole of the translation guide 5', 5" and the mobile element is prevented from its longitudinal translation.

In a subsequent step, the maneuvering lever 18, 19 is axially shifted along the rotation axis W, so as to disengage the second rotation pin 21 from the first stop hole.

In a subsequent step, the mobile element 4 is moved longitudinally along the axis X, for example towards the configuration of at least partial superimposition. When the rotation pin 21 encounters a subsequent stop hole, it engages the latter so as to stop the longitudinal translation of the mobile element 4.

According to one embodiment variation, the extremity of the maneuvering lever 18 opposite that bearing the rotation pin 21 comprises elastic means, for example a spring, suitable for holding the rotation pin 21 against the translation guide 5', 5" or suitable for engaging it in the stop holes.

The present invention furthermore relates to a movement assembly 28.

The movement assembly 28 comprises a fixed frame 2, for example of a vehicle, which extends in a frame plane Z and defining within it a frame opening 3, a mobile element 4, such as for example a door, a window or similar, in relation to a fixed frame 2 and suitable for being engaged in the frame opening 3, and at least one movement device 1, according to any of the previously illustrated embodiments.

According to a preferred version, the fixed frame 2 comprises a lateral portion 29, which extends in the frame plane Z and which is positioned laterally to the frame opening 3.

Preferably, the lateral portion 29 is at least partially transparent to the light.

The present invention lastly relates to a vehicle, such as a motor vehicle or a boat, comprising a movement device 1 according to any of the previous embodiments, or comprising a movement assembly 28 according to one of the aforesaid embodiments.

The functioning of the device just illustrated will now be described.

For ease of exposition, the functioning of the portion shown in the exploded view in FIG. 6 only will be described, that is to say of that relative to the first longitudinal translation guide 5'. However, for the embodiments which foresee a pair of guides, the functioning of the second longitudinal translation guide 5" is the same as the first 5'.

Furthermore, a device comprising a pair of translation pins 16', 16" will be considered. However, the functioning principle is substantially the same for a larger or smaller number of pins.

The mobile element 4 is initially positioned in the configuration of non-alignment with the frame opening 3.

In such configuration, the mobile element 4 cannot be seen by an observer in the frame opening 3, except for a small segment adjacent to the first rim 4*a*, in that it is mainly aside from the frame opening 3, and is mainly hidden by the lateral portion 29, in those embodiments which foresee it.

In a subsequent functioning step, illustrated in FIGS. 9*a* and 9*b*, the mobile element 4 is moved along the longitudinal translation guide 5', along the primary translation axis X, between the configuration of non-alignment and the configuration of at least partial superimposition.

During this step, the translation pins 16', 16", joined to the mobile element 4, slide along the longitudinal translation guide 5' and, specifically, along the translation track 12'.

In other words, the translation pins 16', 16" are guided by the first 10 and by the second shoulder 11, or by the first shoulder 10 and by the longitudinal cordon 13, parallel to the frame plane Z.

Moreover, in this step, the maneuvering lever 18, 19 is rotated in the first position, so that the translation pins 16', 16", going through the through slots 25, 26 of the translation plate 22, 23, 24, are respectively positioned at the terminal section 25" and the first vertex 26'.

In this step, the translation plate 22, 23, 24 thus translates jointly with the mobile element 4.

The translation along the primary translation axis X is interrupted when the translation pins 16', 16" go in abutment against the respective deviator element 6', 6", engaged by such pins 16', 16" emerging from the underside of the through slots 25, 26. The deviator elements 6', 6" thus act as stop elements.

In other words, the translation along the axis X terminates when the translation pins 16', 16" are substantially positioned at the entrance of the respective transversal groove 9', 9" of the deviator element 6', 6".

Similarly, according to an advantageous embodiment, in the configuration of non-alignment, the stop position is reached when the translation pin 16' goes in abutment against the surface 30 of the deviator element 6", opposite that defining the transversal groove 9".

In a subsequent step, the maneuvering lever 18, 19 is rotated manually towards the second position, to bring the mobile element 4 between a configuration of at least partial superimposition (shown in FIG. 2) and an advanced or closing configuration (shown in FIG. 1).

This way, the second rotation pin 21 of the maneuvering lever 18, 19 rotates inside the engagement hole 27, while the first rotation pin 20 of the lever 18, 19 rotates inside the bush 17, joined to the translation pin 16", moving the translation plate in relation to the deviator element 6', 6".

Specifically, the translation of the translation plate 22, 23, 24 in relation to the deviator element 6', 6" is provoked by the longitudinal translation of the second rotation pin 21 and of the relative axis of rotation W, as the translation pin 16" is prevented by the second wall 8" of the deviator element 6" from translating according to the direction of rotation of the lever 18, 19.

In fact, when the rotation of the maneuvering lever 18, 19 begins, the translation pin 16" finds itself against the second wall 8" and begins to engage the transversal groove 9" along the secondary trajectory Y.

As illustrated previously, the contact surfaces of the through slot 25, 26 with the translation pin 16', 16" constitute in fact cam surfaces 31, 32, 33, 34. In this step the first cam surface 31 of the slot 26 co-operates with the second wall 8" of the deviator element 6", in order to push the translation pin 16" along the transversal groove 9" in the reciprocal movement.

Similarly, the rotation of the maneuvering lever 18, 19 is also transmitted to the connection element 22 at the other extremity 23 of the translation plate 22, 23, 24.

In correspondence of such extremity 23, the second cam surface 32 of the slot 25 co-operates with the first wall 7' of the deviator element 6', so as to push the translation pin 16' along the transversal groove 9'.

As shown in FIGS. 10*a* and 10*b*, the translation pin 16" begins to run inside the transversal groove 9", at the same time moving along the second through slot 26, and the translation pin 16' begins to run inside the transversal groove 9', at the same time moving along the first through slot 25, bringing the rims 4*a*, 4*b* of the mobile element 4 closer to the vertical uprights 2*a*, 2*b* of the frame 2.

Lastly, having completed the rotation of the maneuvering lever 18, 19, as illustrated in FIGS. 11*a* and 11*b*, the mobile element 4 is at least partially engaged in the frame opening 3, as each translation pin 16', 16" is positioned at the terminal section 25' and the second vertex 26" of the translation plate 22, 23, 24, and is further positioned at the end of the transversal groove 9', 9" of the deviator element 6', 6", preferably against the second shoulder 11.

During the disengagement of the mobile element 4 from the frame opening 3, performed by rotating the maneuvering lever 18, 19 in the direction opposite that just illustrated, functioning is obviously the inverse of that just shown.

Innovatively, the device and assembly of the present invention may be used with mobile elements of any thickness, guaranteeing functioning and reliability in any case. In fact, thanks to the use of the guiding means of the mobile element as described above, the transversal movement of the same is performed by making the mobile element enter the frame opening with a simultaneous movement of the opposite rims, that is of pure translation (at least along the terminal section of the entrance trajectory), which enables use of mobile elements of any thickness. The absence of rotatory movements in fact, does not limit neither the longitudinal extension nor the encumbrance of the mobile element to be used with the present device.

Furthermore, thanks to the movement of pure translation of the rims of the mobile element into the frame opening, the device runs substantially flush with the uprights of the frame, making it possible to reduce (or even eliminate) the presence of sealing means between the frame and the mobile element.

Advantageously, the device of the present invention, is highly versatile, permitting easy assembly and a number of applications, for both land vehicles, boats and habitations.

Advantageously, the disposition of the mobile element in the closing configuration, substantially at the same height as the lateral portion permits a considerable reduction of the noise produced by the vehicle when moving, because the air hitting such surfaces passes over them without encountering obstacles and thus without generating annoying whistlings.

Furthermore, this way any water accumulation, for example rainwater, inside the frame opening is prevented.

Advantageously, the presence of at least one recess along the longitudinal cordon ensures that the deviator element remains in its seat without the use of special, additional fastening means.

Advantageously, the translation plate is composed of three separate components, so that the parts most subject to wear can be replaced as required.

Moreover, the possibility of replacing the connection element with another with a bigger or smaller axle base, means that the translation plate can be adapted to diverse manufacturing needs.

Advantageously, the presence of at least one through slot having terminal portions extending longitudinally further allows security against intrusion from the outside, especially by burglars or prowlers.

Moreover, the presence of a through slot having terminal portions extending longitudinally guarantees greater functioning safety, preventing the accidental crushing of user's extremities.

A person skilled in the art may make modifications, adaptations and substitutions to the embodiments of the device and of the assembly described above so as to satisfy contingent requirements, while remaining within the scope of protection as defined by the following claims.

For example, the replacement of the longitudinal translation guide previously illustrated with a guide having a different transversal cross-section, but fulfilling the same function, does not entail any inventive effort.

Each of the features described as belonging to a possible embodiment may be realised independently of the other embodiments described.

The invention claimed is:

1. A device for moving a mobile element such as a door or window relative to a fixed frame defining an opening, said device comprising:

a fastening element fixed to the mobile element, said fastening element having a translation pin extending therefrom and a bush attached thereto, a longitudinal translation guide for guiding the mobile element along a primary translation axis, substantially parallel to the frame, between a configuration of at least partial superimposition of the mobile element with the frame opening, and at least one configuration of non-alignment with the opening;

a deviator guide for guiding the mobile element along a secondary trajectory intersecting said primary translation axis, said deviator guide having a transverse groove for guiding the translation pin along said secondary trajectory; and a maneuvering lever connected to the mobile element for moving the mobile element along said secondary trajectory, between the configuration of at least partial superimposition and a closed configuration, wherein the mobile element is engaged in the frame opening;

said maneuvering lever having first and second pins extending therefrom and being rotatable around a rotation axis, said rotation axis being substantially orthogonal to the primary translation axis, a translation plate having a hole receiving said second pin and a cam slot receiving said translation pin, and said first pin being seated in said bush attached to the fastening element, whereby one can rotate said maneuvering lever to move the mobile element along the secondary trajectory to the closed configuration.

2. Device according to claim 1, wherein the mobile element remains substantially parallel to the frame plane.

3. Device according to claim 1, wherein the mobile element comprises a first and a second rim, spaced along the primary translation axis, and wherein the maneuvering lever engages the rims in the frame opening simultaneously.

4. Device according to claim 1, wherein the contact surfaces of the through slot with the translation pin constitute cam surfaces extending in an inclined manner in relation to the primary translation axis and the secondary trajectory, in order to push the translation pin along the transversal groove.

5. Device according to claim 1, wherein the deviator element comprises a first and a second wall, distanced from each other along the primary translation axis and defining between them the transverse groove.

6. Device according to claim 5, wherein the longitudinal translation guide comprises a first and a second shoulder, identifying at least one translation track, and wherein the first wall of the deviator element extends between the first and second shoulder.

7. Device according to claim 5, wherein the longitudinal translation guide further comprises a longitudinal cordon, substantially parallel and comprised between the first and the second shoulder, and wherein the second wall of the deviator element extends between the longitudinal cordon and the second shoulder.

8. Device according to claim 1, wherein the translation plate comprises a first and a second through slot, spaced along the primary translation axis.

9. Device according to claim 8, wherein the first through slot extends mainly in an substantially rectilinear direction inclined in relation to the primary translation axis and in relation to the secondary trajectory.

10. Device according to claim 8, wherein the first through slot presents at least one terminal section, extending substantially parallel to the primary translation axis.

11. Device according to claim 10, wherein the translation plate comprises a first and a second terminal section, wherein the extension of the first terminal section is greater than that of the second.

12. Device according to claim 8, wherein the second through slot extends along a curvilinear trajectory between a first and a second vertex.

13. Device according to claim 12, wherein a line between the first and the second vertex of the second through slot corresponds substantially to the distance between the first and the second terminal section of the first through slot.

14. Movement assembly comprising:

a fixed frame lying in a frame plane and identifying within it a frame opening;

a mobile element, such as a door, a window or similar, in relation to the fixed frame and engageable in the frame opening; and at least one movement device according to claim 1.

15. Assembly according to claim 14, wherein the fixed frame comprises a lateral portion, extending in the frame plane and positioned laterally to the frame opening, the lateral portion being at least partially transparent to light.

16. Vehicle, such as a motor vehicle or a boat, comprising a device according to claim 1.

* * * * *